US005829234A

United States Patent [19]

Suolahti

[11] Patent Number: 5,829,234

[45] Date of Patent: Nov. 3, 1998

[54] DEVICE FOR WINDING A WRAPPING FILM AROUND AN ARTICLE TO BE PACKAGED

[75] Inventor: Yrjö Suolahti, Masku, Finland

[73] Assignee: Oy M. Haloila Ab, Finland

[21] Appl. No.: 916,953

[22] Filed: Aug. 25, 1997

[30] Foreign Application Priority Data

Aug. 23, 1996 [FI] Finland ..... 963303

[51] Int. Cl.[6] ..... B65B 53/00; B65B 27/06

[52] U.S. Cl. ..... 53/556; 53/588; 53/204; 100/27

[58] Field of Search ..... 53/588, 210, 556, 53/204, 409, 589; 100/27, 28, 12

[56] References Cited

U.S. PATENT DOCUMENTS

| | | | |
|---|---|---|---|
| 3,331,312 | 7/1967 | Leslie et al. | 53/589 X |
| 3,783,575 | 1/1974 | Angenendt | 53/589 X |
| 3,930,442 | 1/1976 | Buttner | 53/588 |
| 4,723,393 | 2/1988 | Silbernagel | 53/556 |
| 5,282,347 | 2/1994 | Cleine et al. | 53/588 X |

FOREIGN PATENT DOCUMENTS

| | | |
|---|---|---|
| 0 747 287 | 12/1996 | European Pat. Off. . |
| 29 44 930 | 5/1981 | Germany . |
| 36 18 255 | 3/1987 | Germany . |
| WO 93/07059 | 4/1993 | WIPO . |

*Primary Examiner*—Linda Johnson
*Attorney, Agent, or Firm*—Schwartz & Weinrieb

[57] ABSTRACT

Device for winding a wrapping film around an article (1) to be packaged, the article to be packaged having the shape of a substantially flat rectangle in cross-section. The article to be packaged comprises two substantially parallel broad sides (2, 3) and two narrow sides (4,5), the edges between the broad and narrow sides forming supporting points (6) for the wrapping film. The device comprises a film distributor (7) disposed to travel along a ring-like endless track (8) at a substantially constant speed around the article to be packaged. The track (8) of the film distributor (7) is so formed that the track radius (r) from the track to the supporting point (6) increases continuously at least in the track area (S) where the film portion (12) drawn from the roll in the direction of the radius and stretched between the film distributor and the supporting point (6) approaches a position parallel to at least one broad side (2; 3) of the article being packaged, such position corresponding to a point (0) where a straight line in the direction of the broad side intersects the track (8), so that, when the point (0) is being approached and at the point, a tangent (T) to the track is at a smaller angle to the straight line in the direction of the broad side than a tangent to an imaginary circular path, the rate of increase of the radius (r) at least in the area of the track and the rate of delivery of film from the film roll (9) being higher than if the track followed the imaginary circular path mentioned.

20 Claims, 4 Drawing Sheets

DEVICE FOR WINDING A WRAPPING FILM AROUND AN ARTICLE TO BE PACKAGED

FIELD OF THE INVENTION

The present invention relates generally to winding apparatus, and more particularly to apparatus for winding a wrapping film around an article to be packaged.

BACKGROUND OF THE INVENTION

In the prior art, devices for winding a wrapping film around an article to be packaged are known. Each device comprises a film distributor which Is disposed to move along a ring-like endless track at a substantially constant speed around the article to be packaged and which comprises a removable and replaceable film roll, supporting elements to support the film roll on the film distributor, and a tensioning device to retard film delivery and to achieve a proper film tension. Usually the track is of a circular form.

When the article to be packaged has the shape of a substantially flat rectangle in cross-section and the cross-sectional form thus comprises two broad sides parallel to each other and two narrow sides parallel to each other, a circular distributor track causes problems because the film is slackened when laid on the broad side. This is due to the fact that, since the article being wrapped is of a flat shape, its broad surface lies very close to the diameter of the circle. The corner edge between the broad and narrow sides constitutes a supporting point for the wrapping film when the film is being wound around the article. Thus, during the wrapping operation, the film, which extends between the supporting point and the film distributor, is no longer stretched when it approaches the direction of the diameter of the circle. In other words, the rate of film delivery is reduced to almost zero as the radius from the supporting point to the track is not increasing. Therefore, the film is slackened before it is laid onto the broad side. Typically, the film on the broad side is creased and the wrapping is not tight. Film tightness on the narrow side is no problem, but a problem is encountered in the fact that the rate of film delivery increases from nearly zero to a relatively high level when the narrow side is reached, and the film distributor should be able to adjust itself to this change. Thus, the problem with winding a wrapping film around an object of the shape indicated is the large variation in the rate of film delivery.

A new application in wrapping technology is the wrapping of bundles of steel sheets and rolls of steel band in plastic sheeting. So far, these articles have been manually wrapped in paper, which has been a difficult and expensive job, which is why it is now becoming common practice to wrap them in plastic. If the layers of plastic wrapping remain loose however, moisture will penetrate between and under the steel sheets or plies of steel band, which may damage the packaged goods.

OBJECTS OF THE INVENTION

The general object of the present invention is to eliminate the present drawbacks mentioned above.

A specific object of the invention is to present a device in which the rate of film delivery can be optimized so as to achieve a sufficient film tension and a rate of film delivery as constant as possible without any large variations.

SUMMARY OF THE INVENTION

According to the invention, the track of the film distributor is so shaped that the track radius from the track to the supporting point increases continuously at least in the track area where the film portion drawn from the roll in the direction of the radius and stretched between the film distributor and the supporting point approaches a position parallel to at least one broad side of the article being packaged, the position corresponding to a point where a straight line in the direction of the broad side intersects the track, so that, when the point is being approached and at such point, a tangent to the track is at a smaller angle to the straight line in the direction of the broad side than a tangent to an imaginary circular path, the rate of increase of the radius at least in the area of the track and the rate of delivery of film from the film roll being higher than if the track followed the imaginary circular path mentioned; and that, at and after the point on the track where the supporting point changes, the rate of increase of the radius remains substantially the same as before such point, with no substantial changes occurring in the rate of increase of the radius.

The invention has the advantage that the film delivery rate on the broad side at the most critical phase of film delivery is sufficient to ensure an adequate film tension to achieve a tight and wrinkle-free wrapping. In addition, after the point where the supporting point changes, the radius increases again from the new supporting point at substantially the same rate.

In an embodiment of the device, a tangent to the track in the track area is at an angle smaller than 90° to the direction of the broad side.

In an embodiment of the device, the shape of the track is so chosen that the rate of film delivery from the film roll is substantially constant in the area in question.

In an embodiment of the device, the track is of an oval shape which is substantially different from a circular shape, resembling an ellipse.

In an embodiment of the device, the track comprises straight portions and portions having the form of a circular arc.

In an embodiment of the device, the diameter of a circle drawn around the track and touching opposite extreme points of the track, passing through such opposite points, is at a sharp angle to the symmetry axis parallel to the broad side of the cross-section of the article to be packaged.

In an embodiment of the device, the track is symmetrically disposed, with respect to the article to be packaged, in such a manner that the distances perpendicular to the opposite narrow sides of the article and from the track are substantially equal.

In an embodiment of the device, the track is so arranged that the track radius from the track to the supporting point increases substantially steadily as a function of the angle of rotation as the radius turns through an angle of 0°–180° about the supporting point as center.

In an embodiment of the device, the track is designed to conform with the function:

$$r = m \cdot e^{\left(\frac{1}{\pi} \ln \frac{l+m}{m}\right)\phi},$$

when the ratio $$\frac{\Delta s}{\Delta r} = \text{constant},$$

where r=radius of the track from the supporting point,

Δr=change of radius r, s=advance or the wrapping device along the track circumference, Δs=change of advance s, l=width of the cross-section of the article to be packaged, or width of the broad side, m=distance of the narrow side of the article to be packaged from the track, in the widthwise direction of the article, e=base 2,718282 of the natural logarithm, ϕ=angle of rotation of the radius r relative to a straight line parallel to the broad side.

In an embodiment of the device, the device comprises a skeleton; a wrapping frame supported by the skeleton and forming the track; and the film distributor comprises a film distributor carriage whose movement is guided by the wrapping frame.

In an embodiment of the device, the article to be packaged, example a bundle of steel sheets, is a body of rectangular shape in cross-section, resembling a parallelepiped which has a length, a width and a thickness, where the width corresponds to the width of the broad side of the cross-section and the thickness corresponds to the length of the narrow side of the cross-section.

In an embodiment of the device, the device comprises a conveyor for conveying the article to be packaged through the wrapping frame.

In an embodiment of the device, the article to be packaged is a cylindrical body, example a roll of steel band, the longitudinal cross-section of the wall of the cylindrical body corresponding to the aforenoted cross-section of the article to be packaged, the width of the body corresponding to the aforenoted width of the broad side of the cross-section and the thickness of the wall to the aforenoted thickness of the narrow side of the cross-section. The cylindrical body has a central hole going through the body in the widthwise direction. The wrapping frame is disposed to pass through the hole.

BRIEF DESCRIPTION OF THE DRAWINGS

In the following, the invention will be described in detail by the aid of a few examples of its embodiments by referring to the attached drawings, in which like reference characters designate like or corresponding parts throughout the several views, and wherein.

DETAILED DESCRIPTION OF THE ILLUSTRATED EMBODIMENTS

Figure 1:
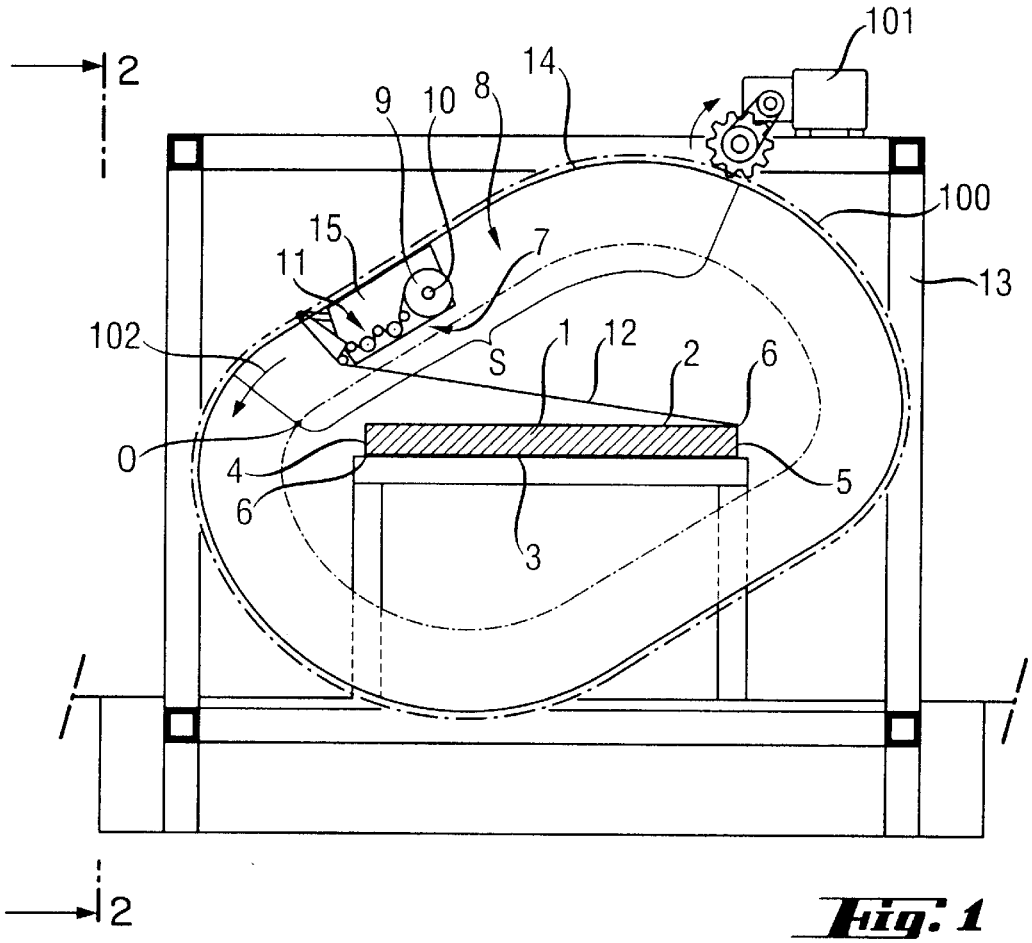
FIG. 1 is a front elevational view of a first embodiment of the device of the invention.
Figure 2:
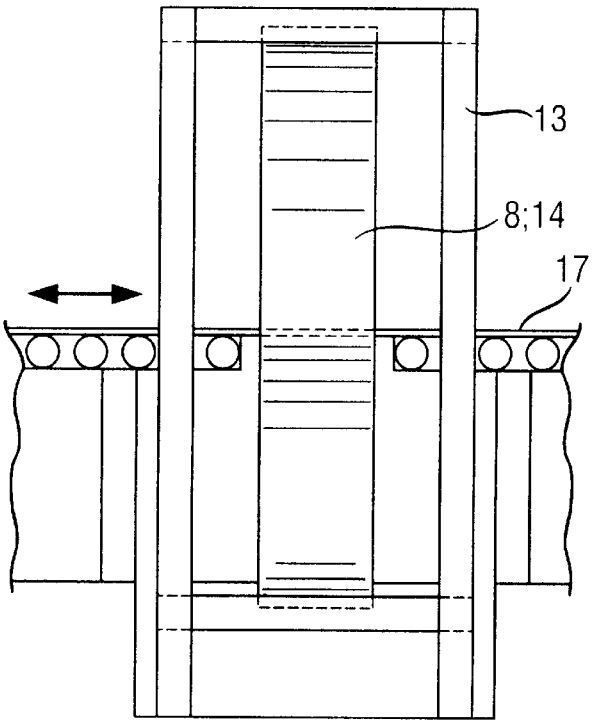
FIG. 2 is a cross-sectional view of the device of FIG. 1 as seen along lines 2—2 of FIG. 1.

FIGS. 1 and 2 disclose a device for winding a wrapping film around an article 1 to be wrapped. As shown in FIG. 1, the article 1 to be wrapped is of a substantially flat rectangular shape in cross-section. The article 1 to be wrapped comprises two broad sides 2, 3 substantially parallel to each other and two narrow sides 4, 5 substantially parallel to each other. The corner edges between the broad and narrow sides form supporting points 6 for the wrapping film when it is being wound around the article 1.

The wrapping device comprises a film distributor so controlled that it runs along an endless ring-like track 8 at a substantially constant speed around the article 1 to be packaged. The film distributor 7 comprises a removable and replaceable film roll 9, support elements 10 to support the film roll 9 on the film distributor 7, and a tensioning device 11 to retard film delivery and to create film tension. The winding device further comprises a skeleton 13. Supported by the skeleton 13 is a wrapping frame 14, which forms the track 8 mentioned above. The film distributor 7 comprises a carriage 15, whose movement is guided by the wrapping frame 14. Further, as shown in FIG. 2, the device comprises a horizontal conveyor 17 for conveying the article longitudinally through the wrapping frame 14, which is disposed in a direction perpendicular to the longitudinal direction. During the wrapping operation, the conveyor 17 feeds the article 1 to be packaged while the film is being wound around the article 1 when it is in the wrapping frame area. The carriage 15 can be moved along the fixed wrapping frame 14 example by means of an endless drive element 100, such as a cogged belt, sprocket chain or the like, which is attached to the carriage 15 and moved by means of a pinion wheel driven by a motor 101. The film distributor 7 may be driven in any manner used with wrapping machines as is known to the person skilled in the art. Thus it is possible in some other application to use a controlled angle lever mechanism following the track 8 to move the film distributor 7 along the track 8 of the invention.

Figure 3:
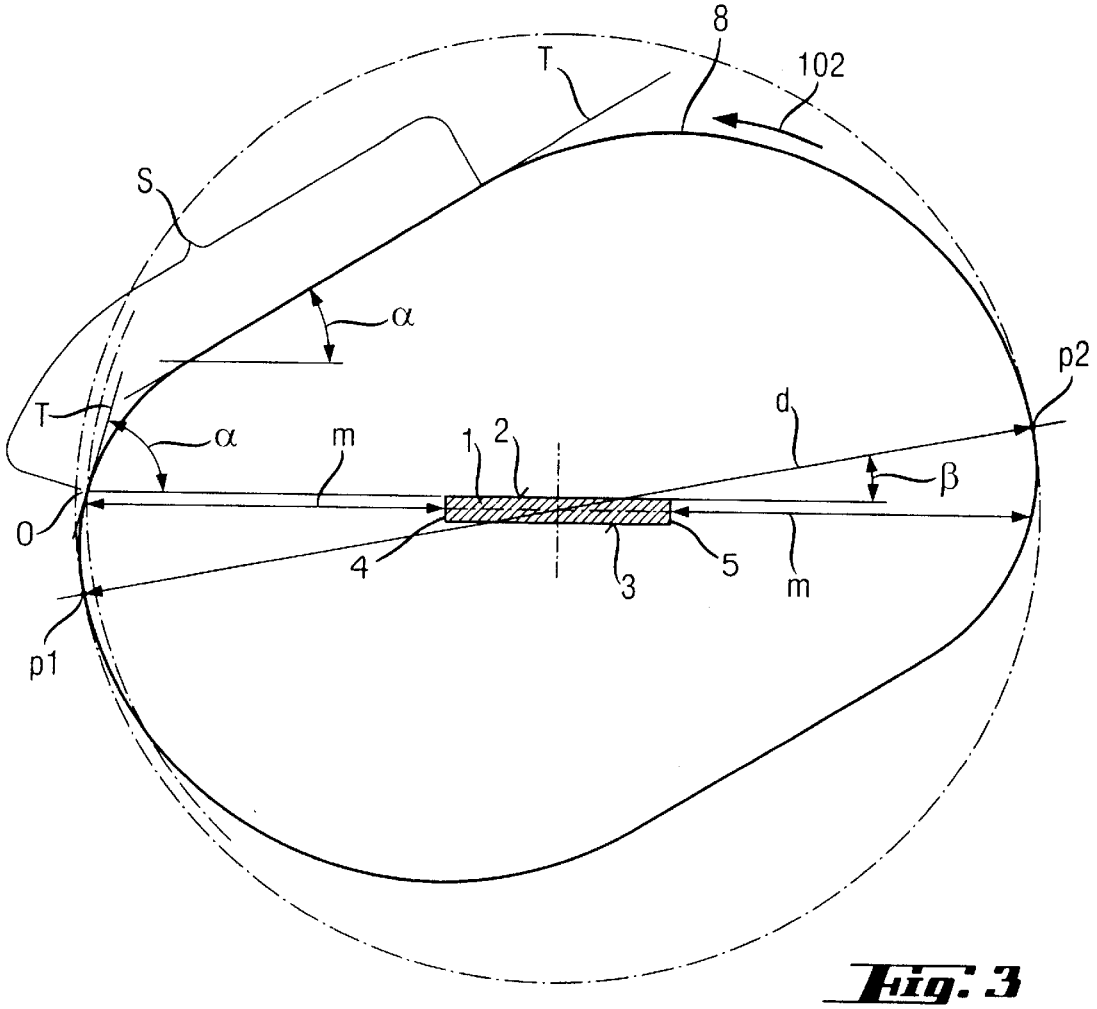
FIG. 3 is a diagram representing the shape of the track of the device in FIG. 1 and a cross-section of an article to be wrapped.
Figure 5:
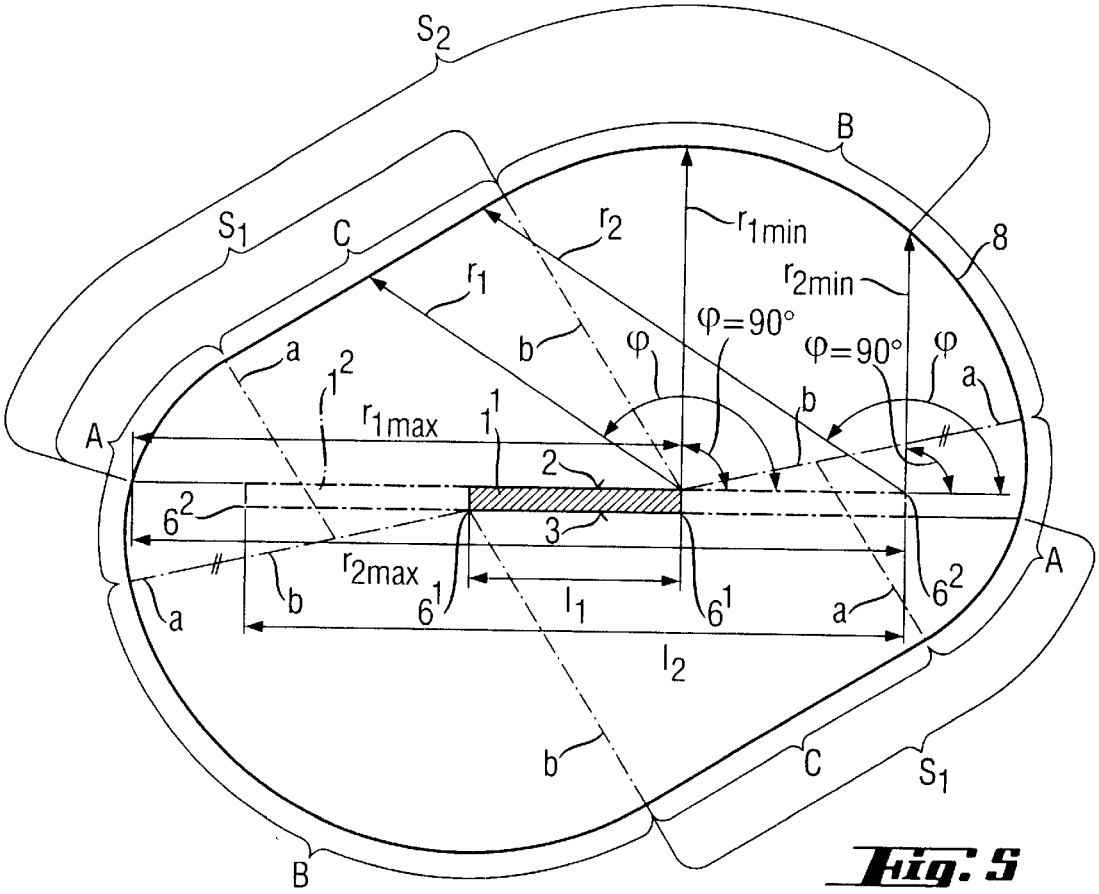
FIG. 5 is a diagram of a track similar to that of FIG. 3, which is designed for an article to be wrapped whose width may vary between the minimum width $L_1$ and the maximum width $L_2$ as shown in the figure.

FIGS. 3 and 5 show a more detailed view of the form of the track 8 through which an optimal film tensioning is achieved. The track 8 of the film distributor 7 is so designed that, as the film distributor 7 is travelling along the track 8, the track radius r from the track 8 to the supporting point 6 increases continuously at least in the track area S where the film portion 12 drawn from the roll 9 and stretched between the film distributor 7 and the supporting point 6 in the direction of the radius approaches a position parallel to at least one broad side 2; 3 of the article 1 being packaged when the film distributor 7 is travelling along the track 8 in the direction of the arrow 102. The film position parallel to the broad side 2; 3 corresponds to a point 0 where a straight line in the direction of the broad side intersects the track 8, so that, when this point 0 is being approached and at this point, a tangent T to the track 7 is at a smaller angle to the straight line in the direction of the broad side than a tangent to an imaginary circular path. Therefore, at least in the area of the track 8, the rate of increase of the radius r and the rate of film delivery from the film roll 9 are higher than zero and in addition are always higher than they would be if the film distributor 7 travelled along the imaginary circular path mentioned. At and after this point 0 on the track 8, the rate of increase of the radius r remains substantially the same as before the point 0, with no substantial changes occurring in the rate of increase of the radius. A tight film covering the surface 2 is thus obtained. Moreover, no sudden changes occur in the rate of increase of the radius r, but instead the rate of increase of the radius r always remains substantially smooth when the supporting point 6 changes. The tangent T to the curve formed by the track 8 has no discontinuities. It the track 8 were different from the optimal track 8 of the invention, then as the supporting point 6 suddenly changes from one location to another, the rate of film delivery would also undergo a sudden change. In the track of the invention, no such changes occur.

As shown in FIG. 3, a tangent T to the track 8 in area S is at an angle substantially smaller than 90° to the direction of the broad side 2,3. The form of the track 8 is so chosen that the rate of film delivery from the film roll 9 remains substantially constant in area S. The track 8 has a form substantially differing from a circular form, resembling an ellipse. The diameter d of a circle drawn around the track 8 and touching opposite extreme points p1, p2 of the track 8, and passing through such opposite points p1, p2, is at a sharp angle β to the broad side 2: 3 of the article 1 to be packaged. The track 8 is symmetrically disposed with respect to the article to be packaged so that the distances m perpendicular to the opposite narrow sides 4, 5 of the article 1 from the track 8 are substantially equal.

As is further shown in FIG. 5, the form of the track 8 is composed of straight portions C and two circular arcs A and B having different radii. The track 8 has been designed using as a basis of design an article $\mathbf{1}^1$ of a relatively small width $l_1$, whose cross-section is shown with solid lines in the figure. The centers of the larger circular arc B are located at the supporting points $\mathbf{6}^1$ while the radius is b. Arc B connects to a circular arc A having a smaller radius a. Between two such combinations of arcs A, B are the straight portions C.

FIG. 5 also shows the cross-section of a wider article $\mathbf{1}^2$ to be packaged, drawn in an outline with dotted broken lines. The track 8 is so designed that, in the case of both articles $\mathbf{1}^1$, $\mathbf{1}^2$ to be packaged, the radius r of the track 8 from the track 8 to the supporting points $\mathbf{6}^1$, $\mathbf{6}^2$ increases almost continuously, at least when the angle of rotation is approaching 180° as a function of the angle of rotation (ϕ) of the radius as the radius turns through the angle range of 90°–180° relative to the straight line parallel to the broad side 2, 3 about the supporting points $\mathbf{6}^1$, $\mathbf{6}^2$ as centers.

Figure 6:
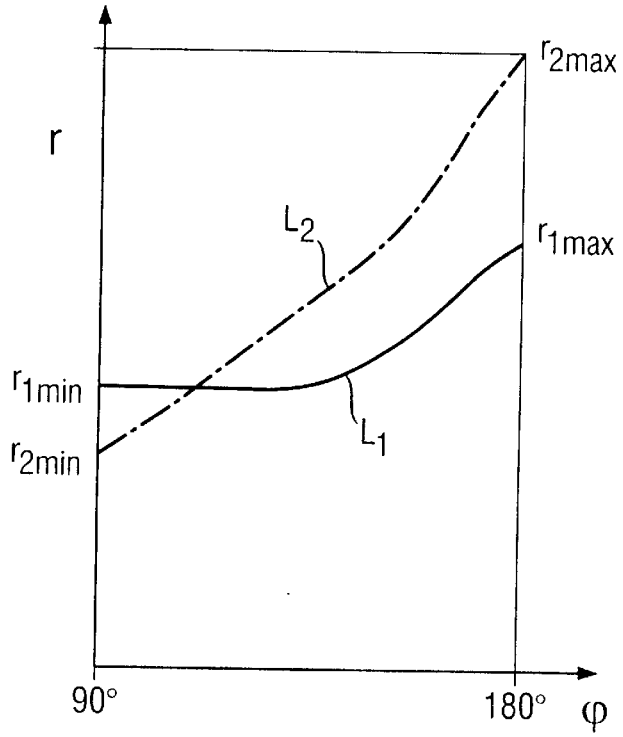
FIG. 6 is a graph which illustrates the change of the track radius as a function of the angle of rotation between 90°–180° for an article of minimum width $L_1$ and for an article of maximum width $L_2$.

The curves in FIG. 6 represent the increase of the radius r in a range of rotation angles of 90°–180° (Note: the radius r is not depicted in the same scale as on FIG. 5). The curve $l_1$ drawn with a solid line represents the change of radius $r_1$ in the case of an article $\mathbf{1}_1$ of smaller width $l^1$. The radius increases in area $S_1$, that is in the range ϕ=120°. . . 180°, as shown in FIG. 5.

The curve $l_2$ drawn with a dotted broken line represents the change of radius $r_2$ in the case of an article $\mathbf{1}^2$ of larger width $l_2$. The radius increases in the whole area $S_2$, that is in the range ϕ=90°. . . 180°, as is also shown FIG. 5.

Figure 4:
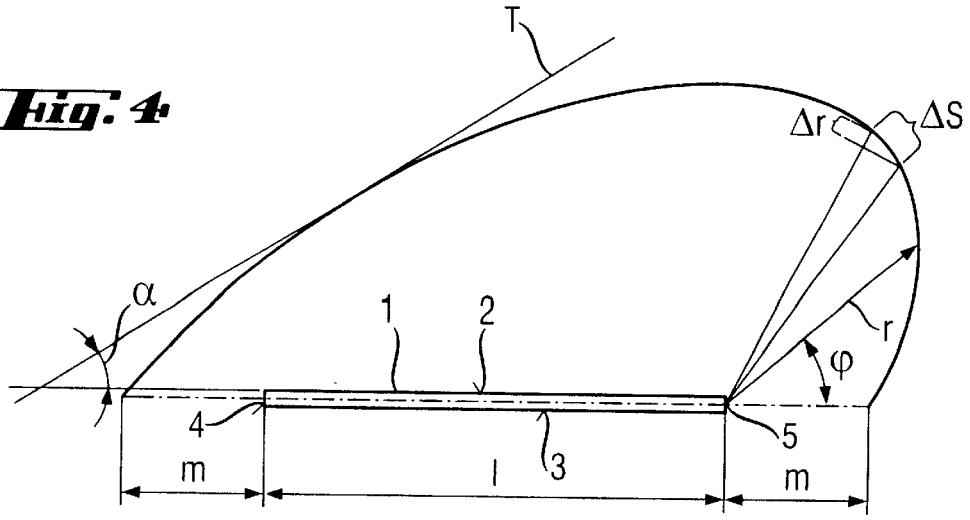
FIG. 4 is a diagram representing a part of the track according to another embodiment.

FIG. 4 presents a second theoretical track 8, one half of which is shown in the figure. The form of the track follows a mathematical function. This function is $$r = m \cdot e^{\left(\frac{1}{\pi} \ln \frac{l+m}{m}\right)\phi},$$

when the ratio $$\frac{\Delta s}{\Delta r} = \text{constant},$$

where r=radius of the track from the supporting point (6),

Δr=change of radius r, s=advance of the wrapping device along the track circumference, Δs=change of advance s, l=width of the cross-section of the article 1 to be packaged, or width of the broad side 2; 3, m=distance from the track of the narrow side 4, 5 of the article to be packaged, in the widthways direction of the article, e=base 2,718282 of the natural logarithm, ϕ=angle of rotation of the radius r relative to the straight line parallel to broad side 2;3.

As a point moves through distance Δs along the track 8, the radius r increases by Δr. The track 8 is so shaped that $$\frac{\Delta s}{\Delta r} = \text{constant}$$

throughout the track. In this example, $$\frac{\Delta s}{\Delta r} = 2.$$

Figure 7:
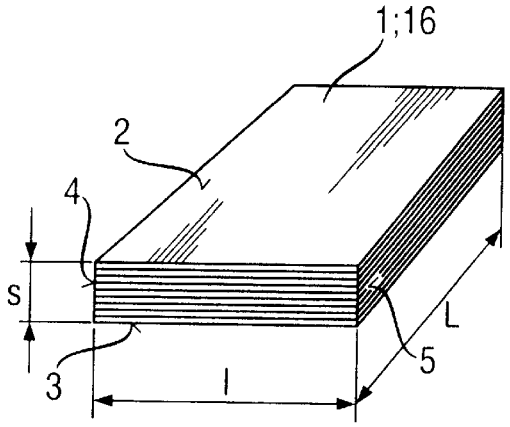
FIG. 7 is a perspective view of an article to be wrapped which is a body having a shape resembling a parallelepiped, such as a bundle of steel sheets.

FIG. 7 discloses an example of an article 1 that can be wrapped using a device as illustrated in FIGS. 1 and 2. The article 1 is a straight bundle 16 of steel sheets, of a rectangular cross-section and resembling a parallelepiped. The bundle 16 of steel sheets has a length L, a width l and a thickness s. The width l corresponds to the width of the broad side 2, 3 of the cross-section of the aforementioned article 1 to be wrapped, and the thickness s corresponds to the length of the narrow side 4, 5 of the cross-section of the aforenoted article 1 to be wrapped.

Figure 8:
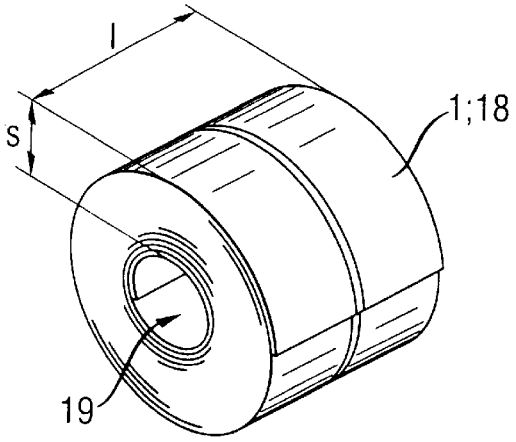
FIG. 8 is a perspective view of an article to be wrapped which is a cylindrical body, such as a roll of steel band.
Figure 9:
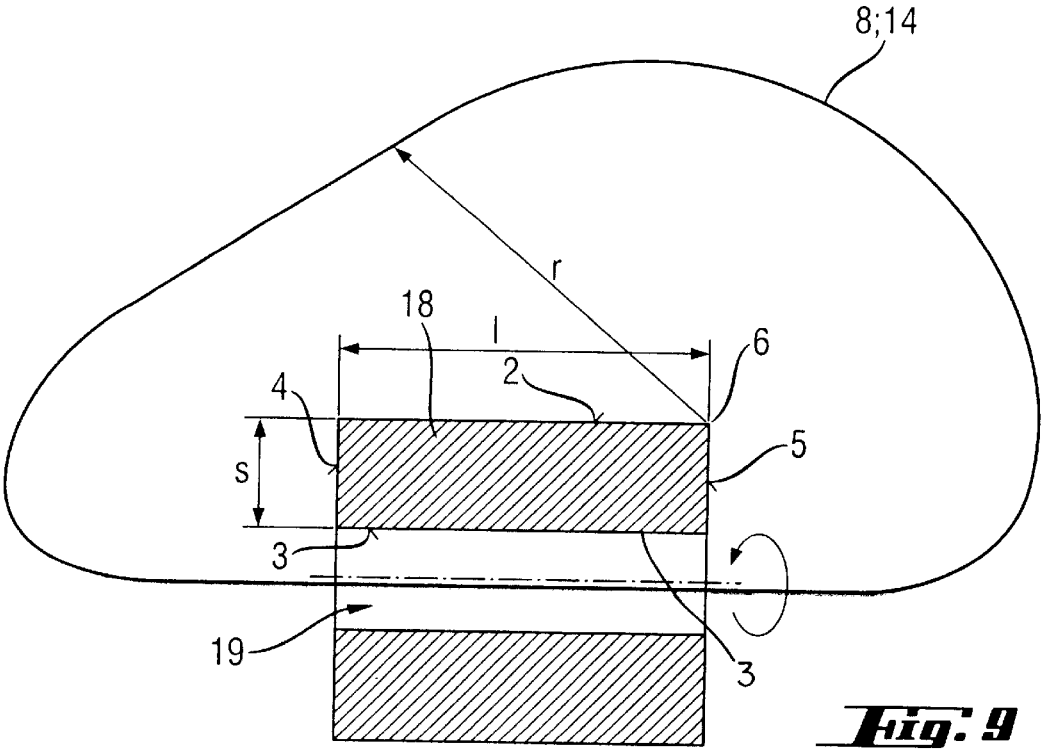
FIG. 9 presents the diagram representing a longitudinal section of a cylindrical body to be wrapped and a shape of a track formed by the wrapping frame according to the invention, the track shape being designed for the cylindrical body.

FIG. 8 discloses an example of an article 1 to be packaged which in this case is a cylindrical body 18, example a roll of steel band. The longitudinal section of the roll 18 corresponds to the cross-section of the aforementioned article 1 to be packaged, so the roll width l corresponds to the aforementioned width of the broad side 2 of the cross-section of the aforenoted article 1 to be wrapped and the wall thickness S corresponds to the aforementioned length of the narrow side 4,5 of the cross-section of the aforenoted article 1 to be wrapped. Such a cylindrical roll 18 has a central hole 19 going through the roll 18 in the direction of the width l. When such a roll 18 is being wrapped, it is rotated about its longitudinal axis while the film distributor carriage (not shown in the figure) is moving along the wrapping frame 14 which comprises a section which passes through the hole 19 as illustrated by FIG. 9. That part of the wrapping frame 14 which is essential with respect to applying a wrapping to the outer surface of the roll 18 follows the track shape corresponding to that presented in FIGS. 3 and 5.

The invention in not limited to the examples of its embodiments described above, but instead many variations are possible within the framework of the inventive idea defined by the claims. It is therefore to be understood that within the scope of the appended claims, the present invention may be practiced otherwise than as specifically described herein.

I claim:

1. Apparatus for winding a wrapping film around an article to be wrapped, wherein the article to be wrapped has the shape of a substantially flat rectangle in cross-section and comprises two substantially parallel broad sides and two substantially parallel narrow sides, the edges between the broad and narrow sides forming supporting points for the wrapping film when the wrapping film is being wound around the article being wrapped, comprising:

a wrapping station having means for supporting an article to be wrapped such that the broad sides of the article to be wrapped are disposed within parallel planes when the article to be wrapped is supported at the wrapping station;

an endless track disposed around said wrapping station; and a film distributor, having a removably replaceable roll of wrapping film rotatably mounted thereon, disposed upon said endless track for movement along said endless track at a substantially constant rate of speed;

said endless track having a configuration which is substantially that of an ellipse, having a major axis and a minor axis, for optimizing wrapping of an article to be wrapped, when the article to be wrapped is disposed at said wrapping station, with said wrapping film wherein said wrapping film will exhibit a predetermined amount of tension so as to be wrapped around the article being wrapped in a substantially tight, wrinkle-free manner, said major and minor axes of said substantially elliptical endless track being inclined at predetermined angles with respect to said parallel planes within which the parallel broad sides of the article are disposed when the article to be wrapped is disposed at said wrapping station such that said entire endless track is disposed substantially symmetrical with respect to said parallel planes and wherein first sections of said substantially elliptical endless track comprise substantially constant radii sections with respect to a first one of the supporting points of the article being wrapped while second sections of said substantially elliptical endless track comprise increasing radii sections, with respect to a first one of the supporting points of the article being wrapped, as said second sections of said substantially elliptical endless track approach a second one of the supporting points of the article being wrapped.

2. Apparatus as set forth in claim 1, wherein:

said means for supporting the article to be wrapped supports the article to be wrapped such that one of the broad sides of the article to be wrapped is disposed within a first plane; and said endless track is disposed with respect to said wrapping station such that said major axis of said endless track, having said configuration which is substantially that of an ellipse, is inclined with respect to said first plane, within which one of the broad sides of the article to be wrapped is disposed, whereby a second plane, connecting opposite corner regions of said substantially elliptical endless track, is substantially coplanar with said first plane.

3. Apparatus as set forth in claim 2, wherein:

said substantially elliptical endless track is disposed with respect to said wrapping station, and the article to be wrapped which is disposed at said wrapping station, such that a radial dimension of said endless track, as defined as extending between said roll of wrapping film, mounted upon said film distributor disposed upon said endless track, and one of the supporting points for said film, of the article to be wrapped, increases continuously within the region of said endless track at which said film, drawn from said roll of wrapping film and extending along said radial dimension of said endless track, approaches a position parallel to one of the broad sides of the article to be wrapped.

4. Apparatus as set forth in claim 3, wherein:

said position corresponds to a point at which a straight line, disposed parallel to the broad side of the article to be packaged and disposed at said wrapping station, intersects said endless track such that a tangent to said endless track at said point is disposed at an angle, with respect to said straight line, which is less than 90°.

5. Apparatus as defined in claim 1, wherein:

said endless track comprises a combination of arcuate portions and straight portions.

6. Apparatus as defined in claim 5, wherein:

said endless track is symmetrically disposed with respect to said wrapping station, and said article to be packaged disposed at said wrapping station, in such a manner that distances extending between the opposite narrow sides of the article to be wrapped and said track are substantially equal.

7. Apparatus as defined in claim 1, wherein:

said track is so arranged with respect to said wrapping station that the radius of said endless track, extending from said roll of wrapping film, mounted upon said film distributor disposed upon said endless track, to one of the supporting points of the article being wrapped, increases substantially steadily as a function of the angle of rotation of the radius of said endless track as the radius of said endless track undergoes rotation through the angle range of 90°–180°, and relative to a straight line disposed parallel to one of the broad sides of the article being wrapped, about one of the supporting points of the article being wrapped which serves as a center.

8. Apparatus as defined in claim 1, wherein:

said track is designed to conform with the function:

$$r = m \cdot e^{\left(\frac{1}{\pi} \ln \frac{l+m}{m}\right)\phi}$$

when the ratio $$\frac{\Delta s}{\Delta r} = \text{constant},$$

wherein r=radius of the track to one of the supporting points of the article to be packaged;

Δr=change of radius r;

s=advance distance of the wrapping device along the track circumference;

Δs=change of advance distance s;

l=width of the cross-section of the article to be packaged, or the width of the broad side of the article m=distance of the track to the narrow side of the article to be packaged, in the widthways direction of the article to be packaged;

e=base 2.718282 of the natural logarithm; and

ϕ=the angle of rotation of the radius r relative to a straight line parallel to a broad side of the article to be packaged.

9. Apparatus as defined in claim 1, wherein said apparatus further comprises:

a skeleton;

a wrapping frame forming said endless track; and said film distributor comprises a film distributor carriage whose movement is guided by said wrapping frame, and a tensioning device for retarding film delivery from said roll of film and for creating a predetermined amount of film tension.

10. Apparatus as set forth in claim 5, wherein:

said arcuate portions of said endless track comprise a first arcuate portion having a first radial dimension, and a second arcuate portion having a second radial dimension different from said first radial dimension.

11. Apparatus as set forth in claim 10, wherein:

said endless track comprises a pair of said first arcuate portions, having said first radial dimensions, symmetrically disposed upon opposite sides of said wrapping station, a pair of said second arcuate portions, having said second radial dimensions, symmetrically disposed upon opposite sides of said wrapping station, and a pair of straight portions symmetrically disposed upon opposite sides of said wrapping station.

12. In combination, apparatus for winding a wrapping film around an article to be packaged, comprising:

an article to be wrapped having the shape of a substantially flat rectangle in cross-section and comprising two substantially parallel broad sides and two substantially parallel narrow sides, the edges between said broad sides and said narrow sides of said article to be wrapped forming supporting points for a wrapping film when the wrapping film is being wound around said article being wrapped;

a wrapping station having means for supporting said article to be wrapped such that said broad sides of said article to be wrapped are disposed within parallel planes when said article to be wrapped is supported at said wrapping station;

an endless track disposed around said wrapping station; and a film distributor, having a removably replaceable roll of wrapping film rotatably mounted thereon, disposed upon said endless track for movement along said endless track at a substantially constant rate of speed;

said endless track having a configuration which is substantially that of an ellipse, having a major axis and a minor axis, for optimizing wrapping of said article to be wrapped, when said article to be wrapped is disposed at said wrapping station, with said wrapping film wherein said wrapping film will exhibit a predetermined amount of tension so as to be wrapped around said article being wrapped in a substantially tight, wrinkle-free manner, said major and minor axes of said substantially elliptical endless track being inclined at predetermined angles with respect to said parallel planes within which said parallel broad sides of said article are disposed when said article to be wrapped is disposed at said wrapping station such that said entire endless track is disposed substantially symmetrical with respect to said parallel planes and wherein first sections of said substantially elliptical endless track comprise substantially constant radii sections with respect to a first one of said supporting points of said article being wrapped while second sections of said substantially elliptical endless track comprise increasing radii sections, with respect to said first one of said supporting points of said article being wrapped, as said second sections of said substantially elliptical endless track approach a second one of said supporting points of said article being wrapped.

13. The combination as set forth in claim 12, wherein:

said means for supporting said article to be wrapped supports said article to be wrapped such that one of said broad sides of said article to be wrapped is disposed within a first plane; and said endless track is disposed with respect to said wrapping station such that said major axis of said endless track, having said configuration which is substantially that of an ellipse, is inclined with respect to said first plane, within which said one of said broad sides of said article to be wrapped is disposed, whereby a second plane, connecting opposite corner regions of said substantially elliptical endless track, is substantially coplanar with said first plane.

14. The combination as set forth in claim 13, wherein:

said substantially elliptical endless track is disposed with respect to said wrapping station, and said article to be wrapped which is disposed at said wrapping station, such that a radial dimension of said endless track, as defined as extending between said roll of wrapping film, mounted upon said film distributor disposed upon said endless track, and one of said supporting points for said film, of said article to be wrapped, increases continuously within the region of said endless track at which said film, drawn from said roll of wrapping film and extending along said radial dimension of said endless track, approaches a position parallel to said one of said broad sides of said article to be wrapped.

15. The combination as set forth in claim 12, wherein:

said endless track comprises a combination of arcuate portions and straight portions.

16. The combination as set forth in claim 15 wherein:

said arcuate portions of said endless track comprise a first arcuate portion having a first radial dimension, and a second arcuate portion having a second radial dimension different from said first radial dimension.

17. The combination as set forth in claim 16, wherein:

said endless track comprises a pair of said first arcuate portions, having said first radial dimensions, symmetrically disposed upon opposite sides of said wrapping station, a pair of said second arcuate portions, having said second radial dimensions, symmetrically disposed upon opposite sides of said wrapping station, and a pair of straight portions symmetrically disposed upon opposite sides of said wrapping station.

18. The combination as set forth in claim 15, wherein:

said endless track is symmetrically disposed with respect to said wrapping station, and said article to be packaged disposed at said wrapping station, in such a manner that distances extending between said opposite narrow sides of said article to be wrapped and said track are substantially equal.

19. The combination as defined in claim 12, wherein:

said article to be wrapped comprises a bundle of steel sheets which defines a body having a rectangular shape in cross-section, and resembling a parallelepiped, which has a predetermined length, a predetermined width, and a predetermined thickness, wherein said predetermined length corresponds to the length of said broad side of said cross-section of said article to be wrapped, and said predetermined thickness corresponds to the length of said narrow side of said cross-section of said article to be wrapped.

20. The combination as defined in claim 12, wherein.:

said article to be wrapped comprises a cylindrical body which is defined by a roll of steel band, the longitudinal cross-section of the wall of said cylindrical body corresponding to said cross-section of said article to be packaged, wherein the length of said body corresponds to the length of said broad side of said cross-section of said article to be wrapped, and the thickness of said wall corresponds to the length of said narrow side of said cross-section of said article to be wrapped.

* * * * *